US011745309B1

(12) United States Patent
Wade

(10) Patent No.: US 11,745,309 B1
(45) Date of Patent: Sep. 5, 2023

(54) REMOTELY OPERATED ABRASIVE BLASTING APPARATUS, SYSTEM, AND METHOD

(71) Applicant: The Government of the United States of America, as represented by the Secretary of the Navy, Arlington, VA (US)

(72) Inventor: Michael Wade, Ijamsville, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 307 days.

(21) Appl. No.: 17/213,977

(22) Filed: Mar. 26, 2021

Related U.S. Application Data

(60) Provisional application No. 63/004,724, filed on Apr. 3, 2020.

(51) Int. Cl.
*B24C 1/08* (2006.01)

(52) U.S. Cl.
CPC ..... *B24C 1/08* (2013.01)

(58) Field of Classification Search
CPC ..... B24C 3/325; B24C 3/32; B24C 3/062; B24C 3/06; B24C 1/08; B24C 7/0007; H02N 2/043
See application file for complete search history.

(56) References Cited

U.S. PATENT DOCUMENTS 2,855,934 A * 10/1958 Daughaday, Jr. ..... A61M 25/0116 254/134.6
3,224,734 A * 12/1965 Hill ..... H02G 1/088 254/134.6
3,330,368 A * 7/1967 Baran ..... H02G 1/06 254/134.6
3,485,237 A * 12/1969 Aldav ..... A61M 25/0116 138/116
3,895,637 A * 7/1975 Choy ..... A61M 25/00 604/916
4,066,070 A * 1/1978 Utsugi ..... A61M 25/1011 600/116
4,372,161 A * 2/1983 de Buda ..... G01M 3/005 254/134.6
5,365,699 A 11/1994 Armstrong
5,386,741 A * 2/1995 Rennex ..... A61B 34/70 901/22
5,758,731 A * 6/1998 Zollinger ..... E21B 23/04 175/51
6,240,595 B1 6/2001 Dupuy
(Continued)

FOREIGN PATENT DOCUMENTS

JP 2000120526 A * 4/2000
JP 2002036199 A * 2/2002
(Continued)

*Primary Examiner* — Joel D Crandall
(74) *Attorney, Agent, or Firm* — Dawn C. Russell; Jesus J. Hernandez

(57) ABSTRACT

A remotely operated abrasive blasting apparatus is provided. Systems incorporating the apparatus, and methods of treating surfaces using the apparatus and systems are also provided. The abrasive blasting apparatus eliminates the need for human operators to be present in the area being treated, and allows areas inaccessible to human operators to be treated.

17 Claims, 6 Drawing Sheets

(56) References Cited

U.S. PATENT DOCUMENTS

| | | | | |
|---|---|---|---|---|
| 6,872,433 | B2 * | 3/2005 | Seward | A61M 25/0116 606/198 |
| 7,237,695 | B2 | 7/2007 | Dee | |
| D562,363 | S | 2/2008 | Dore | |
| 8,057,279 | B2 | 11/2011 | Connelly | |
| 8,353,923 | B2 | 1/2013 | Shturman | |
| 8,936,416 | B2 | 1/2015 | Stutz, Jr | |
| 8,961,271 | B2 | 2/2015 | Roden | |
| 2005/0016637 | A1 * | 1/2005 | Yambe | A61F 2/04 148/402 |
| 2005/0093400 | A1 * | 5/2005 | Johansson | H02N 2/023 310/328 |
| 2021/0290261 | A1 | 9/2021 | Cohen | |

FOREIGN PATENT DOCUMENTS

| | | | | |
|---|---|---|---|---|
| WO | 2009051489 | A1 | 4/2009 | |
| WO | WO-2010093261 | A1 * | 8/2010 | F04B 43/043 |

* cited by examiner $D_1$
$\ell_1$
304
302

$D_2$
$\ell_2$
314
322
324

REMOTELY OPERATED ABRASIVE BLASTING APPARATUS, SYSTEM, AND METHOD

RELATED APPLICATION DATA

This application claims priority under 35 U.S.C. § 119(e) to U.S. Provisional Application No. 63/004,724, filed on Apr. 3, 2020. The entire contents of this provisional application are incorporated herein by reference.

FIELD OF THE INVENTION

The invention provides remotely operated abrasive blasting apparatus, systems incorporating the apparatus, and methods of treating surfaces using the apparatus. The abrasive blasting apparatus eliminates the need for human operators to be present in the area being treated, and allows areas inaccessible to human operators to be treated.

BACKGROUND OF THE INVENTION

While various types of abrasive blasting equipment are known for use in treating surfaces, they create a number of issues and safety concerns for abrasive blasting equipment operators. The surface being blasted may contain toxic materials (such as lead, arsenic, cadmium, silica). In some cases, the abrasive material may itself be toxic (such as silica). The equipment and its operation may generate unsafe levels of noise. Some of these issues can be addressed by using precautionary measures, such as those required by the U.S. Occupational Safety and Health Administration (OSHA).

However, even with advanced safety equipment, workers who operate sandblasting equipment inside shipboard tanks and voids have one of the most labor intensive and hazardous work environments within U.S. Navy shipyards. Removing human operators from these environments can positively impact worker health and productivity, and also improves the quality of the surfaces being treated.

Accordingly, a need remains in the art for abrasive blasting equipment and methods that prevent workers from being exposed to hazards associated with abrasive blasting.

SUMMARY OF THE INVENTION

The invention described herein including the various aspects and/or embodiments thereof, meets the unmet needs of the art, as well as others, by providing remotely operated abrasive blasting apparatus that may be used to treat surfaces, systems incorporating the apparatus, and methods of treating surfaces using the apparatus.

According to a first aspect of the invention, remotely operated abrasive blasting apparatus are provided. The abrasive blasting apparatus beneficially eliminates the need for human operators to be present in the area being treated, and allows inaccessible areas to be treated. The abrasive blasting apparatus includes a functional core, including a conduit for abrasive media and propelling fluid, and an articulated, segmented chassis surrounding the functional core, the segmented chassis including a pump for propulsive fluid, tubing for moving propulsive fluid through the segmented chassis, and grips for attaching one or more segments of the segmented chassis to a surface. The abrasive blasting apparatus is moved through a space using peristaltic action to an area to be treated.

According to another aspect of the invention, abrasive-blasting systems are provided. The systems include an abrasive blasting apparatus including: a functional core, including a conduit for abrasive media and propelling fluid; and a segmented chassis surrounding the functional core, the segmented chassis including: a pump for propulsive fluid, tubing for moving propulsive fluid through the segmented chassis, and grips for attaching one or more segments of the segmented chassis to a surface; a source of abrasive propelling fluid; a source of abrasive media; a mixer for combining abrasive propelling fluid and abrasive media; and a processor programmed to conduct an abrasive blasting operation. The processor conducts the abrasive blasting operation by moving the abrasive blasting apparatus through a space to an area to be treated using peristaltic action, attaching one or more segments of the segmented chassis to a surface, and blasting abrasive propelling fluid and abrasive media at the area to be treated.

A further aspect of the invention provides methods for abrasive blasting surfaces. The methods include providing an abrasive blasting apparatus operably connected to an interface, the interface comprising a processor programmed to carry out an abrasive blasting operation including moving the abrasive blasting apparatus to an area to be treated using peristaltic motion; assessing the area to be treated prior to treatment; conducting an abrasive blasting treatment in the area to be treated, producing a treated area; assessing the treated area after treatment; and determining if the abrasive blasting treatment is complete in the area to be treated. If the abrasive blasting treatment is complete in the area to be treated, the abrasive blasting apparatus is moved to a second area to be treated, and if the abrasive blasting treatment is not complete in the area to be treated, the abrasive blasting treatment is repeated.

Other features and advantages of the present invention will become apparent to those skilled in the art upon examination of the following or upon learning by practice of the invention.

DETAILED DESCRIPTION OF THE INVENTION

This invention addresses the need for remotely operated abrasive blasting apparatus that may be used to treat surfaces, systems incorporating the apparatus, and methods of treating surfaces using the apparatus. The abrasive blasting apparatus eliminates the need for human operators to be present in the area being treated, and allows areas that were previously inaccessible to human-operated abrasive blasting equipment to be treated.

The remotely operated abrasive blasting apparatus of the invention beneficially removes the human operator from inside the ship, tank, or void being treated, allowing them to carry out their work from a safer location. The enhanced optics and maneuverability provided by the remotely operated abrasive blasting apparatus of the invention beneficially increase efficiency of abrasive blasting treatments.

The remotely operated abrasive blasting apparatus, systems, and methods of the invention are not particularly limited as to the types of abrasive media used. The invention may beneficially permit the use of abrasive media that are hazardous to human operators (for example, media that contain silica). Abrasive media for use in the apparatus and methods of the invention include, but are not limited to, steel shot, silicon carbide, aluminum oxide, silica-free glass, and plastics. Dry ice (solid carbon dioxide) can also be used.

The abrasive media may be propelled using any suitable pressurized fluid, such as water, aqueous solutions, ambient air, or other custom gas. The pressure may be created, for example, using a compressor or generator.

Figure 1:
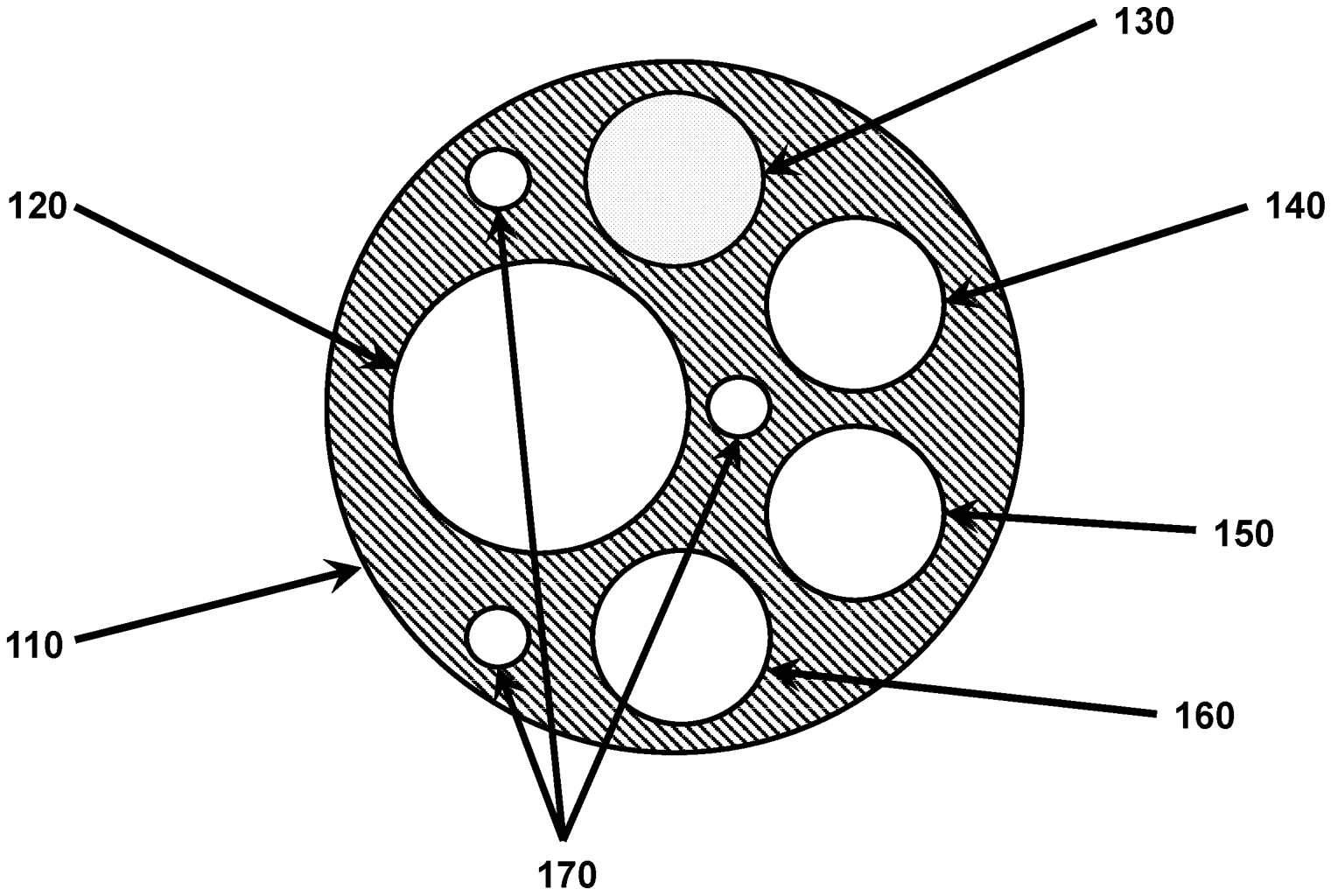
FIG. 1 is a view of a functional core of an abrasive blasting apparatus, including optional additional components augmenting the abrasive blasting apparatus.

As shown in FIG. 1, the remotely-operated abrasive blasting apparatus of the invention includes a flexible outer tube or conduit 110 that includes an abrasive blasting nozzle in communication with tubing 120, which delivers abrasive media and propelling fluid. The flexible conduit 110 forms a functional core for the remotely operated abrasive blasting apparatus. In addition to the source of propelling fluid and abrasive media, the functional core 110 may also optionally include additional inputs or tools, including vacuum or suction tubes to collect dust or debris 130, cameras 140, lights 150, and sprayers 160 to apply coatings to the surface being treated to prevent oxidation or other surface reactions. One or more sensors 170 may also optionally be provided to obtain information relevant to the blasting operation, including, but not limited to, temperature, relative humidity, and surface roughness.

Additional components that provide a desired functionality may also be incorporated into conduit 110, including, but not limited to, data transmission conduit and power sources (not shown). The conduit 110 may also include one or more sensors 170 to detect the position of the apparatus, the composition of the surface (e.g., to detect the presence of rust or other corrosion), and the composition of the surrounding environment (e.g., to detect the presence of harmful gases in the atmosphere), as well as wired or wireless communication components for transmitting the information received using the sensors to a user at a remote location.

Figure 2:
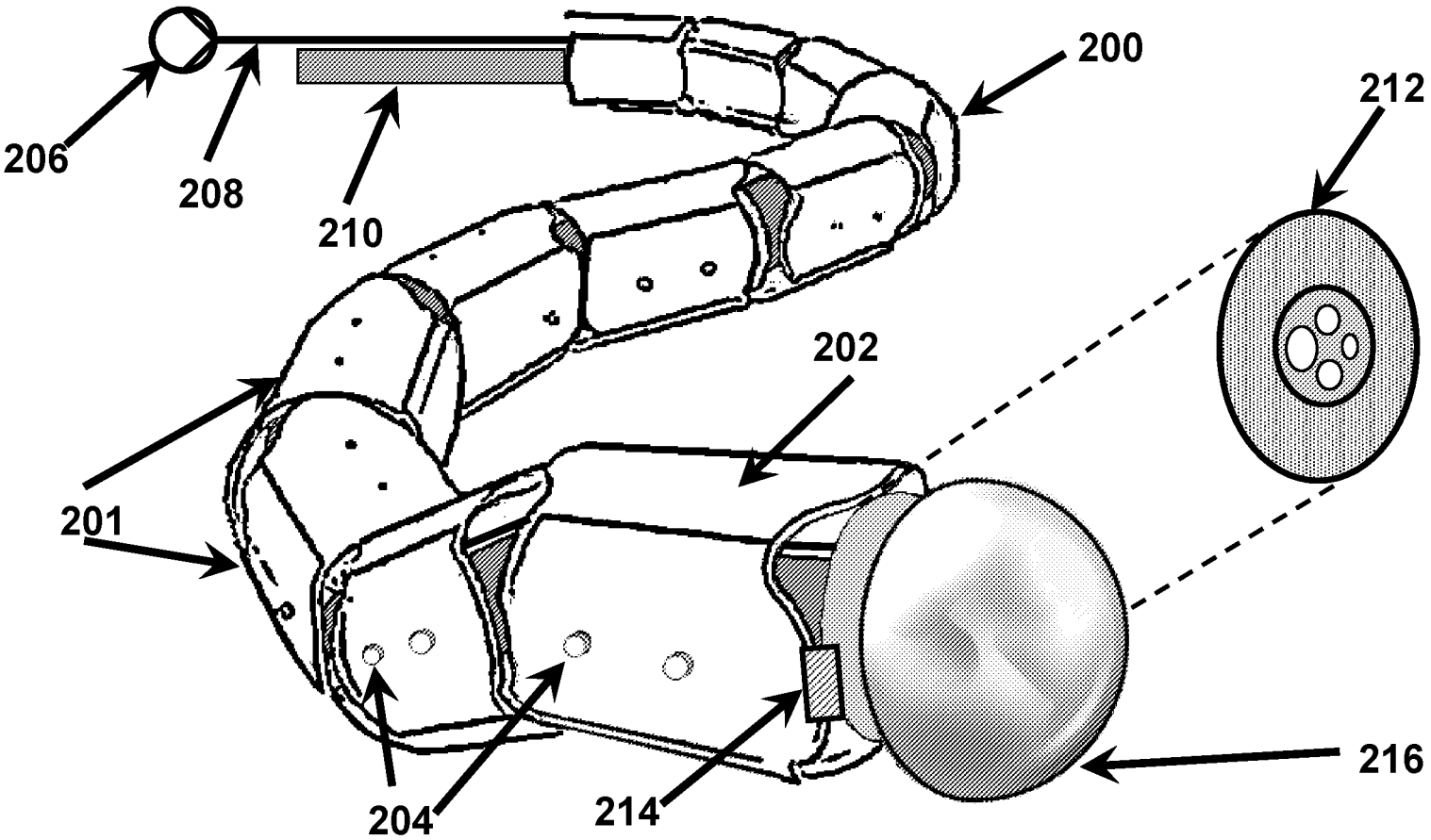
FIG. 2 depicts an abrasive blasting apparatus having an articulated external chassis with multiple segments and a protective cover for the front segment, housing the functional core of the abrasive blasting apparatus.

As shown in FIG. 2, the flexible conduit 210, which incorporates the various inputs and tools therein, is housed within a robot chassis 200 that has multiple segments 201 that may be hydraulically or pneumatically-powered, and may move, for example, using peristaltic action of the hydraulic/pneumatic fluid being transferred to and among the segments. A peristaltic pump (or other positive-displacement pump) 206 and flexible tubing 208 may be incorporated into the apparatus to achieve movement by pumping propulsive fluid through the tubing. In some aspects of the invention, the robot and its range of motion are designed to mimic a snake or worm. One or more of the robotic segments may be locked into position within a space being treated using components 204 incorporated into the segments 201, 202, which may incorporate electromagnetic, magnetic, or suction-based grips.

The end of the flexible conduit 210 that incorporates the abrasive blasting nozzle, cameras, and lights, etc., is incorporated into the foremost segment 202 of the robot chassis 200. The flexible conduit 210 is securely affixed within the foremost segment 202, for example, by incorporating a front plate 212 and fasteners 214 that affix the front plate 212 to segment 202. Like all segments 201 of the robotic chassis, the foremost segment 202 is actuated using a pneumatic or hydraulic system. In some aspects of the invention, the foremost segment 202 includes a protective cover or shield 216 over flexible conduit 210 to protect tools (such as the abrasive blasting nozzle, lights, and cameras) provided in the flexible conduit while the robot is being actuated through the confined space. Once the robot is positioned in the desired location, the shield 216 is retracted so that the inspection, abrasive blasting, or other treatment process can begin.

Suitable hydraulic fluids include mineral oil and water. Suitable pneumatic fluids include, but are not limited to, compressed air, compressed carbon dioxide, and compressed inert gases (such as nitrogen, argon, and noble gases). In some aspects of the invention, the hydraulic or pneumatic fluid used to propel the robot segments is the same as the fluid used to propel the abrasive media used in an abrasive blasting treatment.

The robot body 200 provides adjustable rigidity for ease of movement through confined surfaces, around obstacles, and across discontinuous surfaces. The adjustable rigidity permits the robot to be maintained in a particular configuration during abrasive-blasting operations, and in some instances, fixed or nearly fixed in place using components 204. This beneficially allows for greater precision in abrasive-blasting operations, by maintaining the proximity (and optionally, the orientation) of the blasting nozzle to the work surface within the confined space. The robot body 200 may include an outer shell formed from any durable material, such as metal, plastic, and combinations thereof, as well as hydraulic/pneumatic system components incorporated within the outer shell.

In some preferred aspects of the invention, the robot body segments have an outer diameter that does not exceed 4 inches, and an axial length that does not exceed 8 inches, to avoid difficulty in travelling through confined areas and areas with internal obstructions, such as structural members within a ship hull tank. However, it is to be understood that the robotic chassis of the invention is not limited to any particular shape, diameter, width, segment length, or overall length, and the dimensions may vary depending on the abrasive-blasting environment in which it will be used. The outer diameter, segment length, and overall length of the robot body may be selected to maintain maximum maneuverability within a particular environment to be treated, and may be determined by the size of the confined space and the presence of discontinuous surfaces or obstructions therein.

As shown in FIG. 2, the flexible conduit 210 of the abrasive blasting apparatus may extend beyond the robotic chassis 200 in which it is housed. The robotic chassis 200 may cover the flexible conduit 210, housing the functional core for about 25% to about 75% of the length of the flexible conduit that is advanced into the environment to be cleaned. However, where concerns about the environment include whether it may damage the flexible conduit or any of its internal components, the robot chassis 200 may encompass the flexible conduit over the entire length of the flexible conduit advanced into the environment to be cleaned. In some aspects of the invention, robotic body segments 201 may be added or removed from the blasting apparatus of the invention depending on the particular abrasive blasting treatment and/or environment being treated.

The flexible conduit 210 is operably attached to computers or other user interfaces, recording devices, sources of power, sources of pressurized fluids, sources of abrasive media, and sources of coating materials (not shown). The distance that the flexible conduit extends is not particularly limited, and may be determined, for example, by the size of the area being treated, the distance of the treatment area within a vessel from an access port, and the level of safety hazard presented by the surface being treated or the treatments being conducted (which may be used to help establish how far away from the operator the apparatus should be located during operation).

Figures 3A, 3B, 3C:
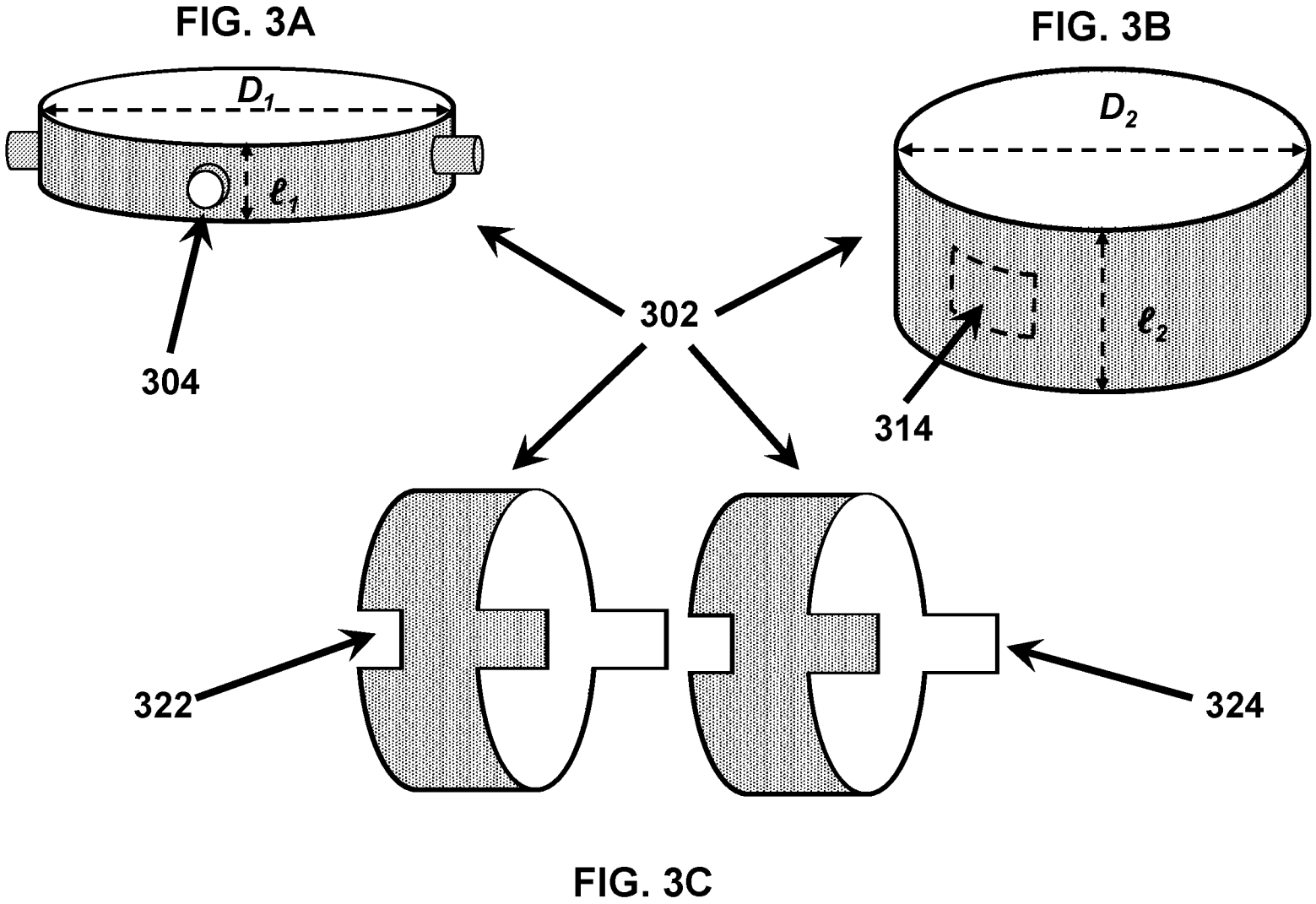
FIGS. 3A, 3B, and 3C depict alternate segment components for an articulated external chassis housing abrasive blasting equipment.

As shown in FIGS. 3A and 3B, the ratio of segment diameters $D_1$ and $D_2$ to segment lengths $l_1$ and $l_2$ may be varied, and the shape of the segments used to form the robotic outer shell or chassis surrounding the functional core may be selected to customize the movement pattern and/or characteristics of the robot. For example, robots intended for operation in areas with multiple obstructions may benefit from a higher ratio of segment diameter (or width, for non-circular cross-sectional areas) to segment length (e.g., about 2:1, about 4:1, about 8:1), which will provide greater flexibility over the length of the robot. When cost is a primary consideration, a robot having a lower ratio of segment diameter to segment length (e.g., about 1:2, about 1:4) requires fewer segments and hydraulic/pneumatic connections, reducing assembly and maintenance costs.

In FIG. 3A, a ratio of segment diameter to segment length of approximately 8:1 is shown, and the robot chassis formed using these segments exhibits a movement pattern having a fluid, serpentine character, which may be beneficial in an environment with multiple obstructions. The robots depicted in FIG. 2 and FIG. 3B have ratios of segment diameter to segment length of about 1:2 and about 2:1, respectively, and exhibit movement patterns that are characterized by more angular patterns, which may be beneficial when locking individual segments into place around obstructions by configuring the robotic chassis segments to create right angles or near-right angles.

Cylindrical segments are shown in FIGS. 3A and 3B, but the invention is not limited to any particular cross-sectional shape or axial profile. In some aspects of the invention, it may be beneficial for the segments to have shapes other than circles for their cross-sectional area, such as rectangular, triangular, hexagonal, octagonal, or other shapes. In other aspects of the invention, in may be beneficial for the side walls to have non-straight edges. For example, as shown in FIG. 3C, notches 322, tabs 324, or both may be provided on the segments, permitting the segments to be joined to each other or to internal components of the robotic chassis using any suitable fastener, such as pins, screws, and rivets. Rectangular notches and tabs are shown at opposite sides of each segment, but any desired notch and tab shapes may be adopted, and the placement of notches and tabs around the segment may be varied to achieve desired movement characteristics.

In some aspects of the invention, combinations of different segment shapes and/or ratios of diameter/width to length may be used within the same robotic chassis, for example, to provide a front portion with enhanced flexibility (i.e., by using segments having a high ratio of segment diameter to segment length at the front end of the robotic chassis) as compared to a rear portion of the robotic chassis, which may use segments having a lower ratio of segment diameter to segment length to provide the rear portion with enhanced ability to form angles and grip surfaces and obstructions within an area to be treated.

In additional aspects of the invention, the hydraulically or pneumatically powered robot may have body segments that incorporate additional functionalities. For example, as shown in FIGS. 3A and 3B, electric, magnetic, electromagnetic, suction, hydraulic, or pneumatic grips 304, 314 may be used to position the robot within the space being treated using abrasive blasting. In FIG. 3A, grip 304 is provided on the outer surface of the segment, while in FIG. 3B, portion 314 may be a grip apparatus provided on the inner surface of the segment that is capable of achieving its effect through the segment wall. In addition to grips, portions 304, 314 of the segments 302 shown in FIG. 3A and FIG. 3B may also be used to house recording apparatus, sensors, position detectors, or other components. When these and additional functions are performed by the robot body and/or robot body segments, power and communication lines may be provided within the segments.

Figure 4:
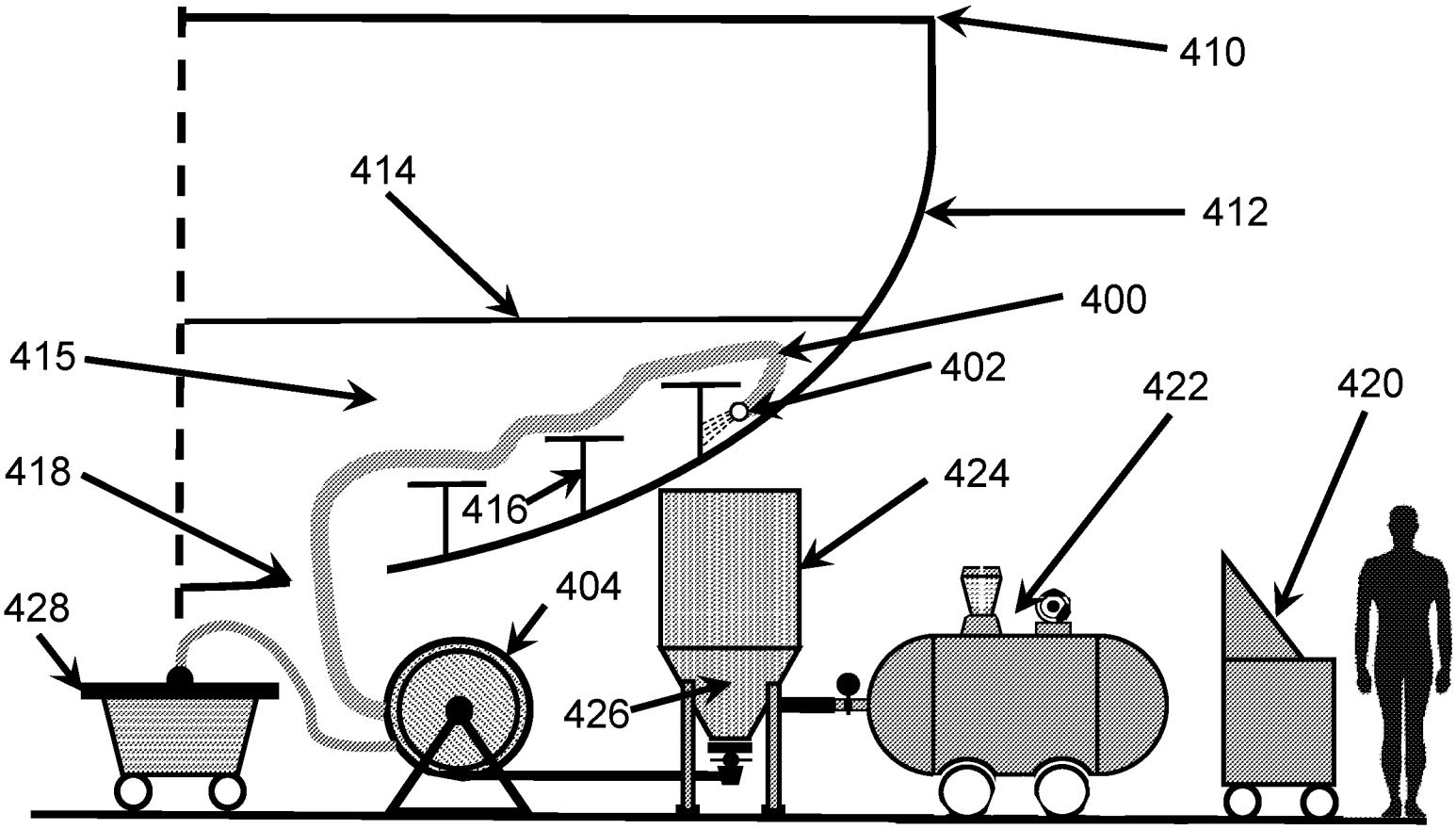
FIG. 4 is a diagram depicting the remotely operated abrasive blasting apparatus and associated equipment forming an abrasive blasting system.

In one exemplary aspect of the invention, depicted in FIG. 4, the apparatus and system of the invention as used in an operation to treat an inner surface of a ship hull tank are illustrated.

A cross-sectional view of a portion of a ship hull is shown, which includes a ship hull main deck 410, ship hull structural side shell 412, ship hull inner bottom tank top 414 that sections off ship inner bottom tank 415, which is strengthened by ship hull internal structural members 416. The ship hull inner bottom tank has an access port or opening 418 provided therein, which allows for maintenance access.

As shown in FIG. 4, the remotely-operated abrasive blasting apparatus 400 may be provided as part of a system that includes one or more of additional elements, including, but not limited to, computers and/or user interfaces 420, which may communicate with recording devices and sensors (not shown) housed in the abrasive blasting apparatus 400 (including, but not limited to, head 402, which includes the abrasive blasting nozzle), sources of power such as batteries, generators, and connections to power outlets (not shown), sources of pressurized fluids 422, sources of abrasive media 424, 426, sources of coating materials (not shown), and sources of vacuum 428. Communication between the various elements and the operator may be maintained via the user interface 420, using connections housed in the flexible conduit or between the flexible conduit and outer robot chassis.

The remotely operated abrasive blasting apparatus 400 is shown deployed within the ship bottom tank 415, for use in a tank cleaning operation. In use, the functional core head 402 of the apparatus 400 is oriented so that an abrasive blasting nozzle therein is directed toward a tank surface to be cleaned. The outer chassis used to orient the core head 402 extends through the ship hull access opening 418 to the area to be cleaned. The outer chassis of the remotely operated abrasive blasting apparatus 400 is tethered to a tether payout reel 404. The tether payout reel 404 is operated to extend the outer chassis of blasting apparatus 400, propelling the head 402 through the interior of the hull tank in conjunction with the hydraulic or pneumatic actuation of the blasting apparatus 400. The outer chassis of blasting apparatus 400 houses a functional core that includes a variety of tools, including, but not limited to, the blasting nozzle aperture, a pressurized air blower, a vacuum debris collector, a light source, a video camera, a position sensor, and a microphone (not shown, see FIG. 1), as well as the hydraulic or pneumatic systems used to propel the blasting apparatus 400 to the area to be treated.

Pressurized air is delivered using an air compressor 422. A vacuum collection system 428 may be provided to remove blasting media and debris loosened from the surface being cleaned. Blasting media is stored in a supply hopper 424, and is mixed in a desired ratio with air from the air compressor 422 in an air-media mixing chamber 426 before being delivered to the functional core head 402 and blasted through the blasting nozzle. Additional equipment supplying optional treatments to be applied to the treated surface, such as paints, sealants, and rust removers, may also be provided.

Preferably, the user interface 420 displays the surface being treated using the images obtained from a camera incorporated into the remotely operated abrasive blasting apparatus 400. The camera may transmit images recorded using visible light, infrared, or laser imaging (LITO) camera technology, in order to provide accurate information regarding the state of the surface being treated. In many instances, the images provided using the remotely operated abrasive blasting apparatus of the invention provide improved clarity and detail as compared to a visual inspection by an operator, improving the efficiency achieved by the abrasive blasting apparatus of the invention.

In some aspects of the invention, equipment elements 400, 404, 422, 424, 426, and 428 are all linked by wired or wireless communication means (for example, cables, wireless signals) to user interface 420, which beneficially enables the operator to respond quickly to information regarding the current operating status of all components of the system. The user interface 420 and user may be in the same area as the equipment, or may be located remotely. In some aspects of the invention, the systems of the invention permit an operator to monitor multiple abrasive blasting operations simultaneously using the user interface 420.

Figure 5:
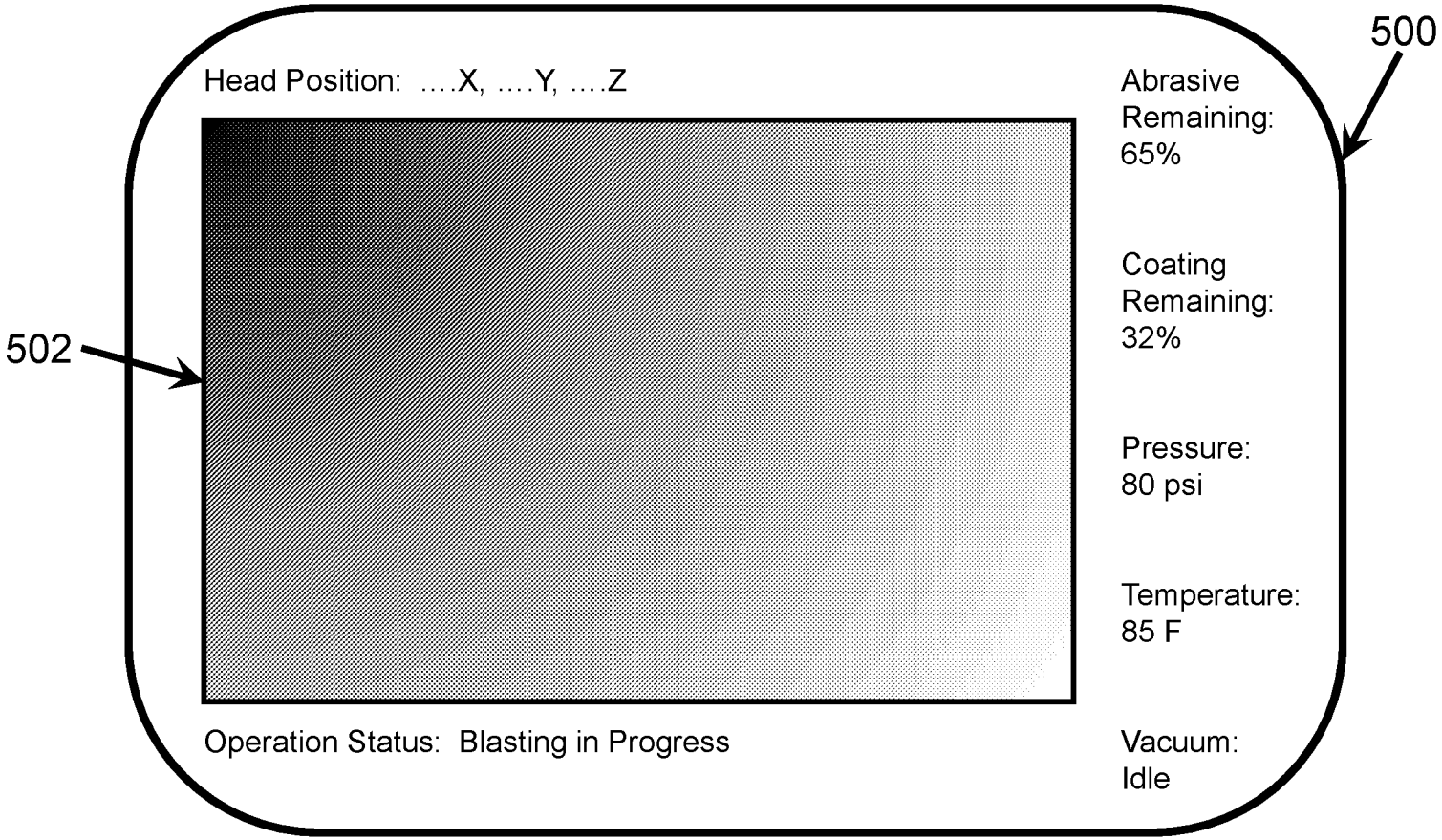
FIG. 5 is a depiction of a user display provided by a user interface incorporated into the abrasive blasting system.

As shown in FIG. 5, in some aspects of the invention, user interface 420 provides a display 500 for the operator, providing information regarding the current status of the various inputs or tools forming the abrasive-blasting system of the invention, alongside images or video 502 of the surface being treated. For example, the amount of abrasive media remaining, the amount of any optional coating materials remaining, the current pressure of the compressed fluid, temperature in the operating area, status of vacuum suction apparatus, and any other parameters may be displayed for the operator, who may be able to take action to address any parameters that are not within a desired target range. This may be accomplished, for example, by replenishing materials or adjusting the output of the compressed fluid generator. When the displayed information is used in combination with the camera image 502, the operator is able to use the controls provided at the user interface 420 to adjust the pressure at which the abrasive mixture is delivered to the nozzle, activate the vacuum to remove debris from the field of view, apply a coating material to the treated surface, or take other actions using the system to conduct the desired surface treatment.

In some aspects of the invention, the remotely operated abrasive blasting apparatus and systems of the invention are operated by an operator who enters commands via the user interface 420. In other aspects of the invention, the apparatus and systems of the invention are operated automatically by a computer programmed to carry out an abrasive blasting operation.

Software may be used to operate the apparatus and systems of the invention, using functions or commands that may include, but are not limited to: moving using pneumatic/hydraulic actuator to a position on a surface being treated; fixing the apparatus at the position using grips in robot segments; visualizing or characterizing the surface at the position prior to treatment; determining whether to conduct abrasive-blasting treatment on the surface at the position; conducting abrasive-blasting treatment on the surface at the position using compressed fluid and abrasive media over a fixed area for a fixed duration of time; visualizing or characterizing the surface at the position after abrasive-blasting treatment; and determining whether to remain in the same position and conduct additional abrasive-blasting treatment or move to a new position on the surface being treated to continue the abrasive-blasting operations. The "determining" functions may be based on operator assessment or visualization, or they may be based on a computer-generated comparisons (such as surface characteristics before the abrasive-blasting treatment versus surface characteristics after the abrasive-blasting treatment).

The remotely operated abrasive blasting apparatus and systems of the invention may be operated in accordance with the methods of the invention for using abrasive blasting to treat surfaces, which permit treatment of confined spaces, optionally using materials that are harmful to human operators. The methods may be carried out using software for translating operator inputs into actions by the remotely operated abrasive blasting system and apparatus. Alternatively, the methods may be carried out by the software using input from position sensors and cameras incorporated into the apparatus, with minimal operator input.

During an abrasive blasting operation, the operator controls the remotely operated abrasive blasting apparatus using the user interface 420. The user interface 420 communicates with the remotely operated abrasive blasting apparatus 400 and associated equipment (e.g., FIG. 4, reference numbers 404, 422, 424, 426, 428) using any suitable communication method, such as wired or wireless communications.

The programmed blasting operation may be conducted based on a map of the area being cleaned that is uploaded into the computer or interface 420. In preferred aspects of the invention, a human operator controls the blasting operation, and makes determinations regarding whether an area has been sufficiently cleaned using information displayed by the user interface 420 as received from an image of the work area obtained using a camera in the apparatus. As shown in FIG. 5, in addition to images of the area being treated, the user interface may display information regarding current status of components of the system, and information regarding the position of the blasting apparatus within the tank.

In other aspects of the invention, the processor may be programmed with information to permit a determination that an area has been sufficiently cleaned. The determination may be based, for example, on comparison of images of the treated area before and after blasting, analysis of the composition of material vacuumed from the work area, comparison of the sound of the blasting medium against the surface being cleaned as the cleaning operation progresses, or any other criteria suitable to the cleaning operation.

Figure 6:
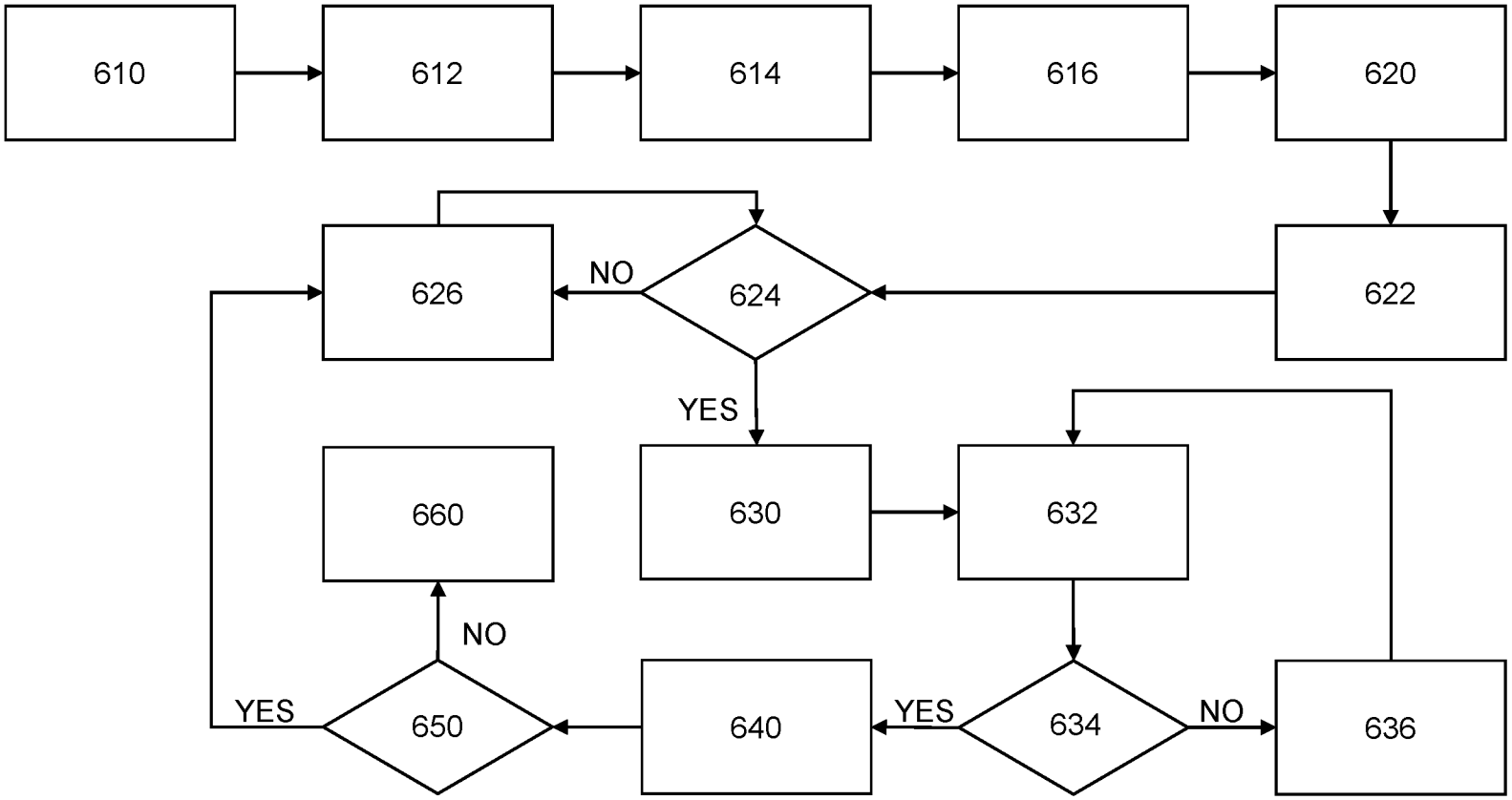
FIG. 6 is a flow chart for operating the remotely operated abrasive apparatus and system in accordance with the methods of the invention.

A flowchart depicting an exemplary method of the invention for abrasive blasting a surface is provided in FIG. 6, though it is to be appreciated that other functions may also be carried out using the systems and methods of the invention.

In a first step 610, the workstation is powered on. As part of the power on process, system checks may be performed to confirm all components of the remote blasting apparatus are functioning normally.

The operator may set an air compressor pressure in step 612 based on the cleaning operation and blasting medium being used. In step 614, the supply hopper level may be checked, and the supply of blasting media replenished. An appropriate air/grit ratio may be selected in step 616 based on the cleaning operation and blasting medium. Once these parameters are set, the system is ready to begin a cleaning operation.

To initiate a cleaning operation, a portion of the outer chassis of the remotely operated abrasive blasting apparatus is placed within the structure being cleaned in step 620. Movement of the blasting apparatus is initiated in step 622, and its progress moving through the tank may be controlled by the operator (for example, using video images obtained from the apparatus), or the work station may control the movement automatically using a position tracking sensor provided in the functional core head (for example, when a treatment area location is entered into the work station). The position of the apparatus may be checked in step 624. If the apparatus is not in the desired position, step 626 continues moving the apparatus toward the area to be treated. The steps of moving the apparatus (626) and periodically checking its position (624) may be repeated as often as necessary until the abrasive blasting apparatus reaches the desired location. Once the blasting apparatus reaches the position to be treated, a blasting operation is conducted in step 630 based on selected settings.

After an interval of blasting, the operation is paused in step 632 to assess whether the objectives for the blasting operation have been accomplished. Depending on the reason for the blasting operation, the objectives may vary, and include dirt/debris removal, paint removal, and rust removal. The measure used to assess the results of the blasting operation may also vary, and in step 632, visual images, surface composition analysis, or other information relevant to the surface treatment may be obtained. In step 634, the information collected in step 632 is used to determine if the surface treatment is complete. If the treated area does not meet the desired objective, the blasting operation is resumed in step 636 in the same location until the surface exhibits desired characteristics. In some instances, this may mean that the surface is treated until it shows substantially less dirt, debris, paint, or rust than before the blasting operation was initiated, preferably 50% less, more preferably 75% less, and in some aspects of the invention, the surface is treated until it is essentially free of dirt, debris, paint, or rust. The operator may optionally adjust the settings for the continued blasting operation using the user interface (for example, adjusting the pressure of the pressurized fluid, adjusting the ratio of blasting medium to propelling medium). The steps of continuing the blasting operation (636), assessing the results of the treatment (632), and determining if the surface treatment is complete (634) may be repeated as often as necessary until the abrasive blasting operation has achieved the desired result.

Once the treated work surface meets the objective for the blasting operation, the operation is stopped in step 640. The system and/or operator then determine in step 650 whether the blasting apparatus is to be moved to a new location for further cleaning (step 626), which initiates the cycle of positioning (steps 624 and 626), followed by the cycle of conducting blasting (steps 630, 632, 634, 636). This may be carried out multiple times to conduct abrasive blasting of a large area.

Once the cleaning operation has been completed (i.e., after step 650 it is determined that there are no additional locations to be cleaned), any grips attaching the remote blasting apparatus to the treatment area are deactivated, and the tether payout reel may be used to retract the remotely operated abrasive blasting apparatus from the area that was treated. After optionally cleaning any residual debris and blasting medium from the surface of the chassis, the remotely operated abrasive blasting apparatus may be stored on the reel until it is needed.

It will, of course, be appreciated that the above description has been given by way of example only and that modifications in detail may be made within the scope of the present invention.

Throughout this application, various patents and publications have been cited. The disclosures of these patents and publications in their entireties are hereby incorporated by reference into this application, in order to more fully describe the state of the art to which this invention pertains.

The invention is capable of modification, alteration, and equivalents in form and function, as will occur to those ordinarily skilled in the pertinent arts having the benefit of this disclosure. While the present invention has been described with respect to what are presently considered the preferred embodiments, the invention is not so limited. To the contrary, the invention is intended to cover various modifications and equivalent arrangements included within the spirit and scope of the description provided above.

What is claimed:

1. An abrasive blasting apparatus, comprising:
- a functional core, comprising a conduit for abrasive media and propelling fluid; and
- a segmented chassis surrounding the functional core, the segmented chassis comprising:
  - a pump for propulsive fluid,
  - tubing for moving propulsive fluid through the segmented chassis, and
  - grips for attaching one or more segments of the segmented chassis to a surface,
- where the abrasive blasting apparatus is moved through a space using peristaltic action to an area to be treated.

2. The apparatus of claim 1, wherein the segmented chassis is pneumatically actuated using pneumatic fluid selected from the group consisting of compressed air, compressed carbon dioxide, and compressed inert gases.

3. The apparatus of claim 1, wherein the segmented chassis is hydraulically actuated using hydraulic fluid selected from mineral oil and water.

4. The apparatus of claim 1, wherein the segmented chassis includes a first segment comprising a protective shield.

5. The apparatus of claim 1, wherein the grips attach the segments to a surface using a mechanism selected from magnetism, electromagnetism, electricity, and suction.

6. The apparatus of claim 1, wherein the functional core further comprises one or more conduits for providing additional functions selected from the group consisting of collecting debris, lighting a surface, transmitting images of a surface, applying coatings to a surface, detecting position, sensing temperature, sensing surface composition, and sensing atmospheric composition.

7. An abrasive blasting system, comprising:
- an abrasive blasting apparatus comprising:
  - a functional core, comprising a conduit for abrasive media and propelling fluid; and
  - a segmented chassis surrounding the functional core, the segmented chassis comprising:
    - a pump for propulsive fluid,
    - tubing for moving propulsive fluid through the segmented chassis, and grips for attaching one or more segments of the segmented chassis to a surface;

a source of abrasive propelling fluid;

a source of abrasive media; and a processor programmed to conduct an abrasive blasting operation, where the processor conducts the abrasive blasting operation by moving the abrasive blasting apparatus through a space using peristaltic action, attaching one or more segments of the segmented chassis to a surface upon reaching an area to be treated, and blasting abrasive propelling fluid and abrasive media through the conduit for abrasive media and propelling fluid toward the area to be treated.

8. The system of claim 7, where the processor carries out repeated cycles of moving the abrasive blasting apparatus, attaching one or more segments of the segmented chassis to a surface, and blasting abrasive propelling fluid and abrasive media toward the area to be treated, until there are no remaining areas to be treated in the space.

9. The system of claim 7, further comprising a source of suction for removing abrasive media and debris from the area to be treated.

10. The system of claim 7, further comprising a visual display for communicating operating parameters of the abrasive blasting system selected from the group consisting of abrasive blasting apparatus position, abrasive media remaining, and abrasive propelling fluid pressure.

11. A method for abrasive blasting surfaces, comprising:

providing an abrasive blasting apparatus operably connected to an interface, the interface comprising a processor programmed to carry out an abrasive blasting operation comprising:

moving the abrasive blasting apparatus to an area to be treated using peristaltic motion;

assessing the area to be treated prior to treatment;

conducting an abrasive blasting treatment in the area to be treated, producing a treated area;

assessing the treated area after treatment; and determining if the abrasive blasting treatment is complete in the area to be treated;

wherein if the abrasive blasting treatment is complete in the area to be treated, the abrasive blasting apparatus is moved to a second area to be treated, and if the abrasive blasting treatment is not complete in the area to be treated, the abrasive blasting treatment is repeated in the area to be treated.

12. The method of claim 11, wherein the step of determining whether the abrasive blasting treatment is complete is conducted by the processor based on a comparison of the assessment of the area to be treated prior to treatment and the assessment of the treated area after treatment.

13. The method of claim 12, wherein the assessment of the area to be treated prior to treatment is conducted using techniques selected from the group consisting of obtaining image data from the treated area, obtaining composition data from the treated area, and combinations thereof.

14. The method of claim 13, wherein the assessment of the treated area after treatment is conducted using the same techniques used to assess the area to be treated prior to treatment.

15. The method of claim 11, where the abrasive blasting is conducted by moving the abrasive blasting apparatus using a map of an area to be treated by abrasive blasting that is stored in the interface.

16. The method of claim 11, where the abrasive blasting is conducted based on operator input to move the abrasive blasting apparatus to an area to be treated.

17. The method of claim 11, where the step of determining whether the abrasive blasting treatment is complete in the area to be treated is conducted by a human operator.

* * * * *